US005842599A

United States Patent [19]

Douma et al.

[11] Patent Number: 5,842,599

[45] Date of Patent: Dec. 1, 1998

[54] PROCESS AND DEVICE FOR DOSING DETERGENT COMPOSITIONS

[75] Inventors: Bennie Douma, Maarssen; Leendert Los, Houten, both of Netherlands

[73] Assignee: Diversey Lever, Inc., Plymouth, Mich.

[21] Appl. No.: 660,941

[22] Filed: Jun. 10, 1996

[30] Foreign Application Priority Data

Jun. 8, 1995 [EP] European Pat. Off. ..... 95201507

[51] Int. Cl.[6] ..... D06F 39/02

[52] U.S. Cl. ..... 222/1; 222/64; 222/67; 222/205; 222/434; 134/93; 68/17 R

[58] Field of Search ..... 68/17 R; 134/93; 222/1, 64, 67, 132, 135, 144.5, 145.5, 205, 282, 434, 438

[56] References Cited

U.S. PATENT DOCUMENTS

| | | | |
|---|---|---|---|
| 3,044,285 | 7/1962 | Koplin | 68/17 R |
| 3,160,317 | 12/1964 | Hambro | 68/17 R |
| 3,771,333 | 11/1973 | Jurjans | 68/17 R |
| 3,804,297 | 4/1974 | Jurjans | 68/17 R |
| 4,362,033 | 12/1982 | Young | 222/64 |
| 5,345,637 | 9/1994 | Pastryk et al. | 68/17 R |

*Primary Examiner*—J. Casimer Jacyna
*Attorney, Agent, or Firm*—A. Kate Huffman

[57] ABSTRACT

A method of delivering a liquid detergent product which may be caustic, is described. In particular, a predetermined volume of water is dosed into a container using a flow meter, a valve means, and, optionally, a water supply pump means. A pump means is activated to deliver the liquid detergent product into the container until it is completely filled as controlled by a level sensor located in the container. The contents of the container are then delivered. A device for carrying out the method is also described.

4 Claims, 2 Drawing Sheets

PROCESS AND DEVICE FOR DOSING DETERGENT COMPOSITIONS

FIELD OF THE INVENTION

The present invention relates to a process and a device for dosing detergent compositions. More in particular, it relates to a process and a device for accurately dosing one or more liquid detergent compositions which may be aggressive and give rise to corrosion.

DESCRIPTION OF RELATED ART

Caustic and viscous chemicals are often not metered but rather pumped during a specified amount of time, because flow meters are expensive and such chemicals may corrode and destroy the flow meters.

Another problem associated with liquid detergent delivery systems of the prior art is concerned with the corrosion of the pumps and tubes applied in such systems to transport the detergent material.

The European patent application corresponding to U.S. Pat. No. 5,014,211 addresses these problems related to the delivery of viscous and caustic chemical materials. This document discloses a liquid chemical delivery system, comprising a liquid distribution line having a plurality of output ports; a manifold coupled to said liquid distribution line; a plurality of pump means coupled to said manifold, each pump means including means for pumping a corresponding chemical into said manifold; transport pump means, coupling said manifold to said distribution line; and water supply means coupled to said manifold.

However, this liquid delivery system is rather complex and expensive. Furthermore, this system was found to be less suitable for accurately dosing liquid detergent chemicals into a washing machine.

BACKGROUND OF THE INVENTION

It is, therefore, an object of the present invention to provide a process for accurately dosing liquid detergent materials, in particular viscous and caustic detergent materials. A further object is to provide a device suitable for carrying out said process. It was surprisingly found that these objects could be achieved with the process and the device of the present invention.

SUMMARY OF THE INVENTION

According to a first aspect of the present invention, there is provided a method of delivering a liquid detergent product, characterised by the steps of (i) allowing a predetermined volume of water to be dosed into a container (1), using a flow meter (3), a valve means (A) and,optionally, water supply pump means; (ii) activating a pump means so as to deliver a liquid detergent product into said container until the container is completely filled, said filling operation being controlled by a level sensor (9) located on the container; (iii) delivering the content of the container.

According to a second aspect of the invention, there is provided a device for carrying out the method according to any of the preceding claims, comprising (a) a container (1) provided with a level sensor (9) and coupled with an output line (10) provided with an output valve (B); (b) one or more pump means (4–7) coupled to said container, each pump means having means for pumping a corresponding detergent product into said container; (c) an input valve means (A) and a flow meter (3) located on a water input line (2) connected to said container and allowing a predetermined amount of water to be accurately dosed; (d) control means connected to said one or more pump means (4–7), said level sensor (9), said input and output valve means (A,B),said flow meter (3) and optionally said water supply pump means, for activating or deactivating specific pump means or the valve means A or B.

DESCRIPTION OF PREFERRED EMBODIMENTS

Accurate dosing is possible with the device of the present invention, for the following reasons. The volume of detergent material to be dosed is determined by the volume of the container controlled with the level sensor and the volume of the water supplied therein and is governed by the equation $$V_d = V_c - V_w,$$

wherein $V_d$ is the volume of the detergent material $V_c$ is the volume of the container $V_w$ is the water volume in said container.

The volume of the container is constant and the volume of the water which is fed into the container before the detergent material is dosed, is programmable and controlled by a flowmeter and valve means located in the water input line. It follows that the detergent material can be accurately dosed by controlling the volume of water fed into the container.

Said volume of water is also suitable for adequately diluting viscous detergent material to be dosed. Furthermore, it is an important characteristic of the device of the invention that no flow meter is needed for controlling the volume of detergent material to be dosed; this is done by the flow meter in the water input line. As a consequence, the flow meter applied cannot be corroded or even destroyed if caustic detergent materials are applied. Furthermore, the flow meter cannot be blocked by undissolved material if suspended liquids are used.

An additional advantage of the process and device according to the present invention is that a predetermined and accurate amount of detergent product can be filled into the container some time before it is needed for use and that, as a consequence, said product can be delivered quickly when it is needed.

The device of the invention is particularly suitable for delivering liquid detergent product into a washing machine. The device of the invention can be used for dosing various amounts of the same liquid detergent product. However, said device is preferably used for dosing various products into a washing machine. In that case, a plurality of pump means is used for pumping corresponding detergent products into the container. Furthermore, control means are present for timely activating specific pump means and dosing accurate amounts of predetermined detergent products into the container.

The device of the invention is particularly suitable for dosing various detergent products into an industrial washing machine.

The control means applied in the device of the invention for (de-)activating specific pump means and the valve means A and B, are preferably such that automatic operation of the device of the invention will be possible.

The maximum volume which can be dosed is restricted by the total volume of the container and two or more dosing procedures are required if more than said volume needs to be dosed.

For cleaning purposes, it is preferred to flush the container by pumping water through it after each time that a liquid product has been pumped into the container and supplied to a washing machine. Furthermore, blockages are prevented from occuring by carrying out this flushing procedure. After the flush with water, a flush with air may be applied.

Examples of detergent compositions which can be dosed by means of the process of the invention are the non-aqeous liquids disclosed in the European patent application 266,199 (Unilever) corresponding to U.S. Pat. No. 5,389,284. When this type of liquids is dosed, it is desirable that these liquids are introduced into the container from the upper side (i.e. on top of the water volume already present therein). Other types of liquid detergent products are, however, usually fed into the container at the bottom side, sa further described below.

BRIEF DESCRIPTION OF THE DRAWINGS

FIG. 1 shows a container 1 into which water has been fed via conduit 2. The amount of water fed or pumped into the container is controlled with flow meter 3 and solenoid valve A. This valve has been closed immediately after the programmed volume of water has been supplied. Subsequently, one of the detergent pumps 4–7 is activated to dose the corresponding detergent product via conduit 8 into the container 1 in which the predetermined volume of water is already present. The supply pump is switched off when container 1 is completely filled. This is detected by a level sensor 9. A float switch is preferably used as level sensor.

For smooth operation of the device of the invention, an air vent 12 is provided on the container 1.

Figure 1:
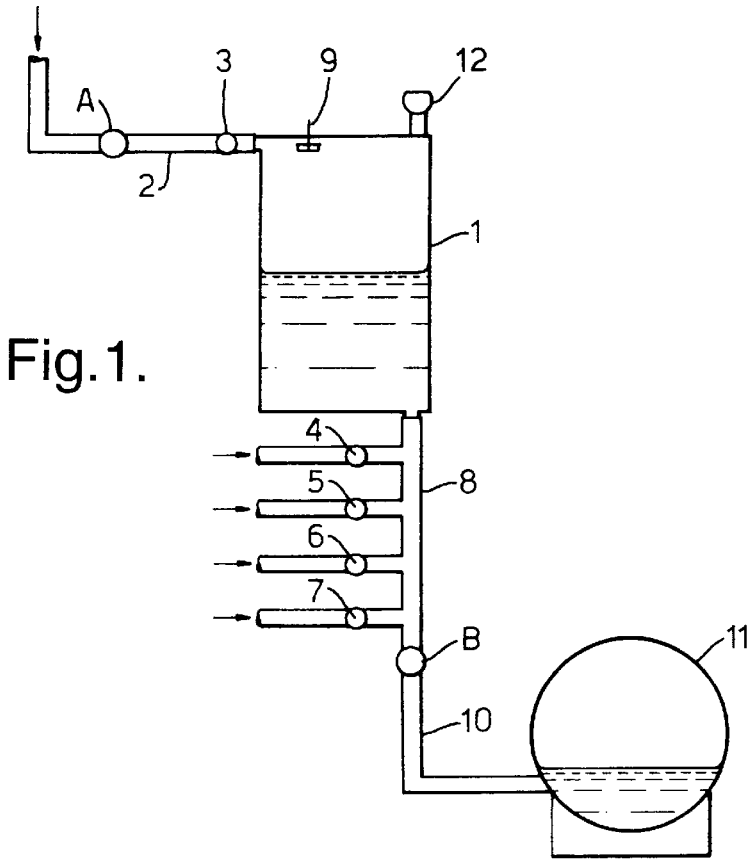
FIG. 1 is a schematic drawing showing a container into which water has been fed.
Figure 2:
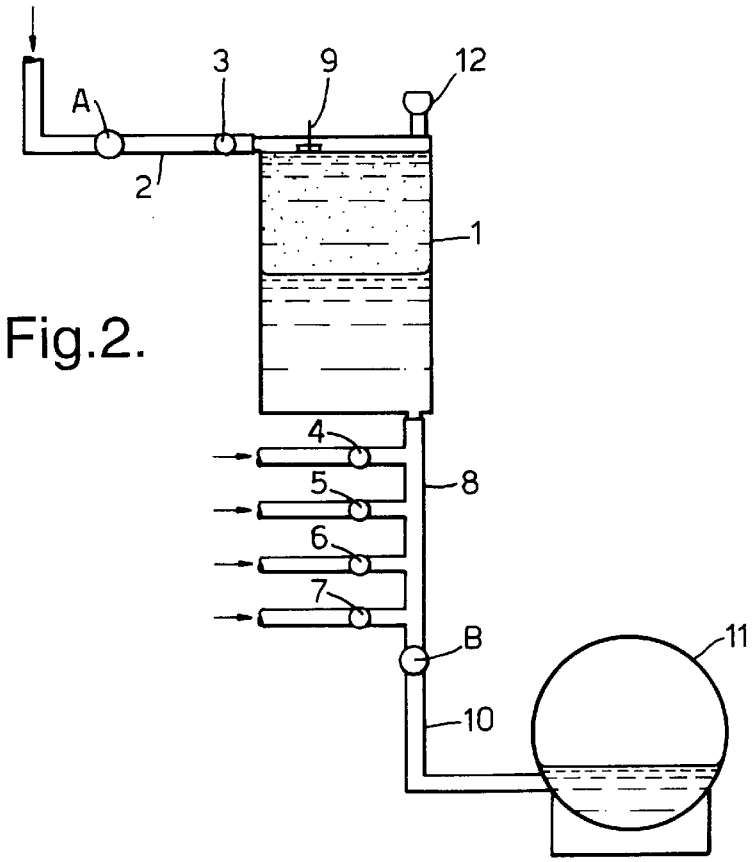
FIG. 2 is a schematic drawing showing the container having both water and detergent material.

FIG. 2 shows the container 1 into which both water and detergent material have been fed.

After the detergent supply pump has been switched off, solenoid valve B is opened to supply the content of the container via conduit 10 into a washing machine 11. As final step of this preferred embodiment of the invention, container 1 and lines 8 and 10 are flushed with water and subsequently with air.

The flush with water is carried out by opening both valve A and B and, optionally, by activating a water supply pump means (not shown).

To further clean container 1 and transport lines 8 and 10, a "flush" with air is applied after the water flush. This air flush is carried out in two steps, as depicted in FIGS. 3 and 4.

Figure 3:
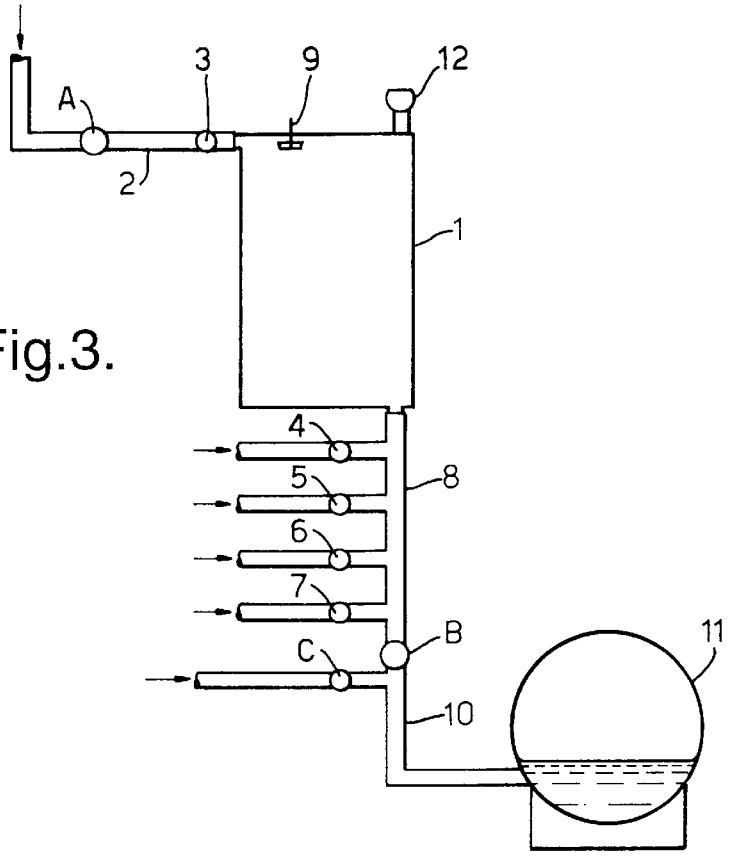
FIG. 3 is a schematic drawing demonstrating the flushing of the system.
Figure 4:
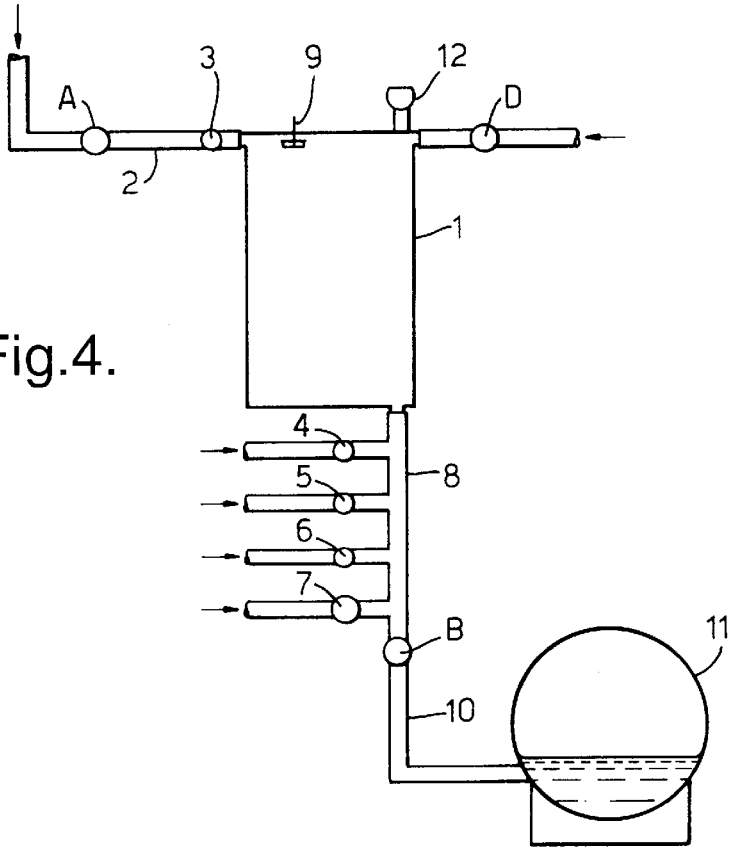
FIG. 4 is a schematic drawing illustrating the end of the flushing process.

First, line 10 is emptied and cleaned by closing valve B and opening air valve C, as shown in FIG. 3.

Subsequently, the rest of the system is cleaned by closing air valve C, opening again valve B, closing air vent 12, and opening air valve D (see FIG. 4).

We claim:

1. A method of delivering a liquid detergent product comprising the steps of:

i) allowing a predetermined volume of water to be dosed into a container, using a flow meter and an input valve associated with the flow meter;

ii) activating pump means so as to deliver a liquid detergent product into said container until the container is completely filled and a filling operation is completed, the filling operation being controlled by a level sensor located on the container;

iii) delivering the detergent product of the container;

iv) opening the input valve so as to have water flowing through said container after each time that a liquid detergent product has been pumped into the container and the contents of the container delivered, thereby flushing the container with water; and v) applying air to further clean and empty the container.

2. A method according to claim 1 wherein the pump means is one of a polarity of pump means for pumping corresponding detergent products into the container.

3. A method according to claim 1 wherein the liquid detergent product exhibits a high viscosity and the detergent is diluted with water in the container and before delivering the detergent product to a washing machine.

4. A method according to claim 1 wherein the liquid detergent product is delivered into a washing machine.

* * * * *